US007267536B2

(12) United States Patent
Acerbi et al.

(10) Patent No.: US 7,267,536 B2
(45) Date of Patent: Sep. 11, 2007

(54) APPARATUS FOR FORMING LARGE-DIMENSION CERAMIC TILES

(75) Inventors: Pier Ugo Acerbi, Imola (IT); Paolo Mongardi, Imola (IT)

(73) Assignee: Sacmi-Cooperativa Meccanici Imola-Soc. Coop. A.R.L., Imola (Bologna) (IT)

( * ) Notice: Subject to any disclaimer, the term of this patent is extended or adjusted under 35 U.S.C. 154(b) by 372 days.

(21) Appl. No.: 10/927,473

(22) Filed: Aug. 27, 2004

(65) Prior Publication Data

US 2005/0031726 A1 Feb. 10, 2005

Related U.S. Application Data

(62) Division of application No. 09/991,905, filed on Nov. 26, 2001, now Pat. No. 6,800,229.

(30) Foreign Application Priority Data

May 8, 2001 (IT) ..... RE2001A0047

(51) Int. Cl.
*B28B 3/00* (2006.01)
*B29C 43/48* (2006.01)

(52) U.S. Cl. ..... 425/80.1; 425/371; 425/364 R; 425/363

(58) Field of Classification Search ..... 425/80.1, 425/371, 352–355, 363, 365, 364 R
See application file for complete search history.

(56) References Cited

U.S. PATENT DOCUMENTS 6,305,925 B1 * 10/2001 Cassani ..... 425/419

FOREIGN PATENT DOCUMENTS

| | | | |
|---|---|---|---|
| DE | 4415177 | | 11/1995 |
| EP | 0829333 | | 3/1998 |
| EP | 0997248 | | 5/2000 |
| WO | WO96/15888 | * | 5/1996 |
| WO | WO98/23424 A2 | | 4/1998 |

OTHER PUBLICATIONS

Reed, James R., "Principles of Ceramic Processing", Second Edition, 1995, John Wiley & Sons, Inc., New York, NY, pp. 1-449.

* cited by examiner

*Primary Examiner*—Tim Heitbrink
*Assistant Examiner*—Thu Khanh T. Nguyen
(74) *Attorney, Agent, or Firm*—Browdy and Neimark, PLLC

(57) ABSTRACT

Method for forming large-dimension ceramic tiles comprising the following operative stages: feeding a determined quantity of powders into the mould cavity of a first pressing station; pressing said quantity of powders to obtain a slab of congruent material the thickness of which is reduced by a quantity between 20 and 40%; feeding said slab to at least one decorating station which deposits in a controlled manner at least a second layer of powders; feeding said decorated slab to a second pressing station; pressing the decorated slab.

6 Claims, 4 Drawing Sheets

APPARATUS FOR FORMING LARGE-DIMENSION CERAMIC TILES

This is a division of parent application Ser. No. 09/991,905, filed Nov. 26, 2001, now U.S. Pat. No. 6,800,229, issued on Oct. 5, 2004, the contents of which are incorporated herein by reference.

This invention relates to a method for forming tiles of ceramic material, and in particular tiles having dimensions exceeding 50×50 cm.

Methods for forming small-dimension ceramic tiles, i.e. having maximum dimensions of 40×40 cm, are known; these comprise preparing a mass of powders, precompacting it to obtain a flat blank, depositing on said blank, in a controlled manner, at least a second layer of powders to form a surface decoration, and finally pressing the decorated blank to obtain the formed tile.

All the known methods, which involve a material precompacting stage, solve the problem of deaerating the powder mass, however the percentage reduction in the thickness of the powder mass during material precompacting is insufficient to ensure surface stability of the precompacted blank.

As a result, although the powders of said at least one second layer for forming the tile surface decoration are intimately bonded to the powders of the upper surface of the blank, they do not rest on a stable surface, with the consequence that mixing of the decoration powders occurs during transportation of the slab to the second pressing stage. Particularly in the case of elaborately decorated tiles, this causes decoration defects in the finished tile, which show mainly as lack of sharpness along the decoration edges.

SUMMARY

An object of the present invention is to solve the problems of the known art within the framework of a simple and rational solution.

A further object of the invention is to form large-dimension tiles, i.e. tiles having a size up to 180×120 cm and beyond.

The invention attains said objects by virtue of the characteristics stated in the claims.

In particular, with the method of the invention the precompacting pressure is sufficient to create a consistent powder slab presenting good surface stability while at the same time allowing the powders of said at least second layer to mix intimately with the powders of the surface layer of the slab. This ensures that during transport of the decorated slab and its subsequent pressing there is no movement of the decoration powders relative to the surface of the precompacted slab, to consequently obtain a perfect sharpness of the decoration edges.

The invention also provides a forming plant, the special characteristics of which are defined in the claims.

BRIEF DESCRIPTION OF THE DRAWINGS

To better clarify the method of the invention and the relative plant, a preferred embodiment thereof is described hereinafter by way of nonlimiting example and is illustrated in the accompanying drawings.

DETAILED DESCRIPTION

Figure 1:
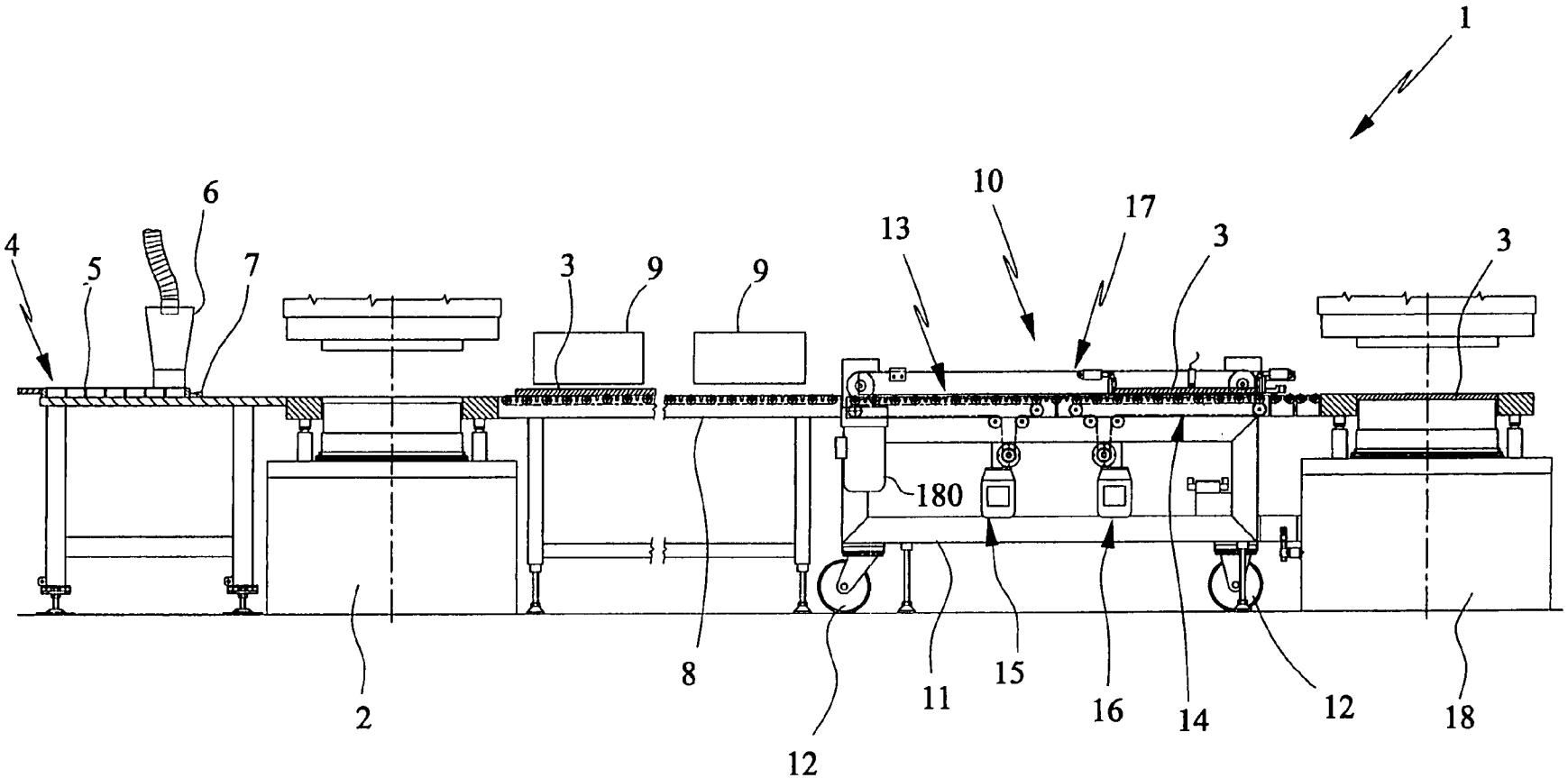
FIG. 1 is a schematic front view of the forming plant according to the invention.

It is stated precisely that in the following description the wording "powder" comprises:

- dry powders (having a moisture degree less than 2%), for instance regranulated and/or atomized glazes, or finely minced ceramic frits,
- semi-dry powders (having a moisture degree between 2% and 6%), for example atomized or milled or micronized (finely grinded) ceramic mixes,
- agglomerated materials, as flakes of ceramic mixtures, flakes of ceramic frits or glazes, and granules (obtained by wet or dry way), and
- wet pastes (having a moisture degree more than 20%) of ceramic mixes (slips), or wet ceramic glazes, or silk screen printing pastes.

The figures show the forming plant 1 for implementing the method of the invention.

The plant 1 comprises a first press 2, in which a consistent (or self-supporting) slab 3 is created from powders.

The ceramic powders are fed into the mould of the press 2 by a usual loading carriage 4 provided with a bottomless slider 5 which is filled with powders by an overlying loading hopper 6.

The carriage is driven with reciprocating rectilinear movement and can translate between a retracted loading position, in which the slider 5 is filled with powders by the hopper 6, and an advanced powder discharge position in which the slider 5 is positioned exactly above the mould cavity of the press 2, to release the powders into the cavity.

In a variant of the invention, the hopper 6 can also be driven with to-and-fro reciprocating movement, to hence load the slider 5 which remains at rest, as described by the Applicant in IT 1248243 (EP 519373).

The carriage 2 is driven by usual means, not shown being of a known type, such as a geared motor.

To the front edge of the carriage there is fixed a usual expeller 7 which, during the advancement of the carriage 4, removes the slab formed by said first pressing station.

Downstream of the first press 2 there is a conveyor 8, the purpose of which is to feed the preformed slab 3 below a plurality of decorating stations 9, each of which is arranged to deposit decorating powders on the exposed surface of the slab in accordance with a predetermined pattern.

For example each of said decorating stations could comprise a plurality of hoppers, not shown, or any other device suitable for the purpose.

To the side of the conveyor 8 there is positioned a device 10 for feeding the slab to a second press 18, forming the second pressing station, and for making the loading rate of the press 18 independent of the decorating rate of said decorating stations 9. Said device comprises a frame 11 provided with wheels 12 and supporting two roller tables 13 and 14, each of which has its own operating unit 15 and 16.

Figure 2:
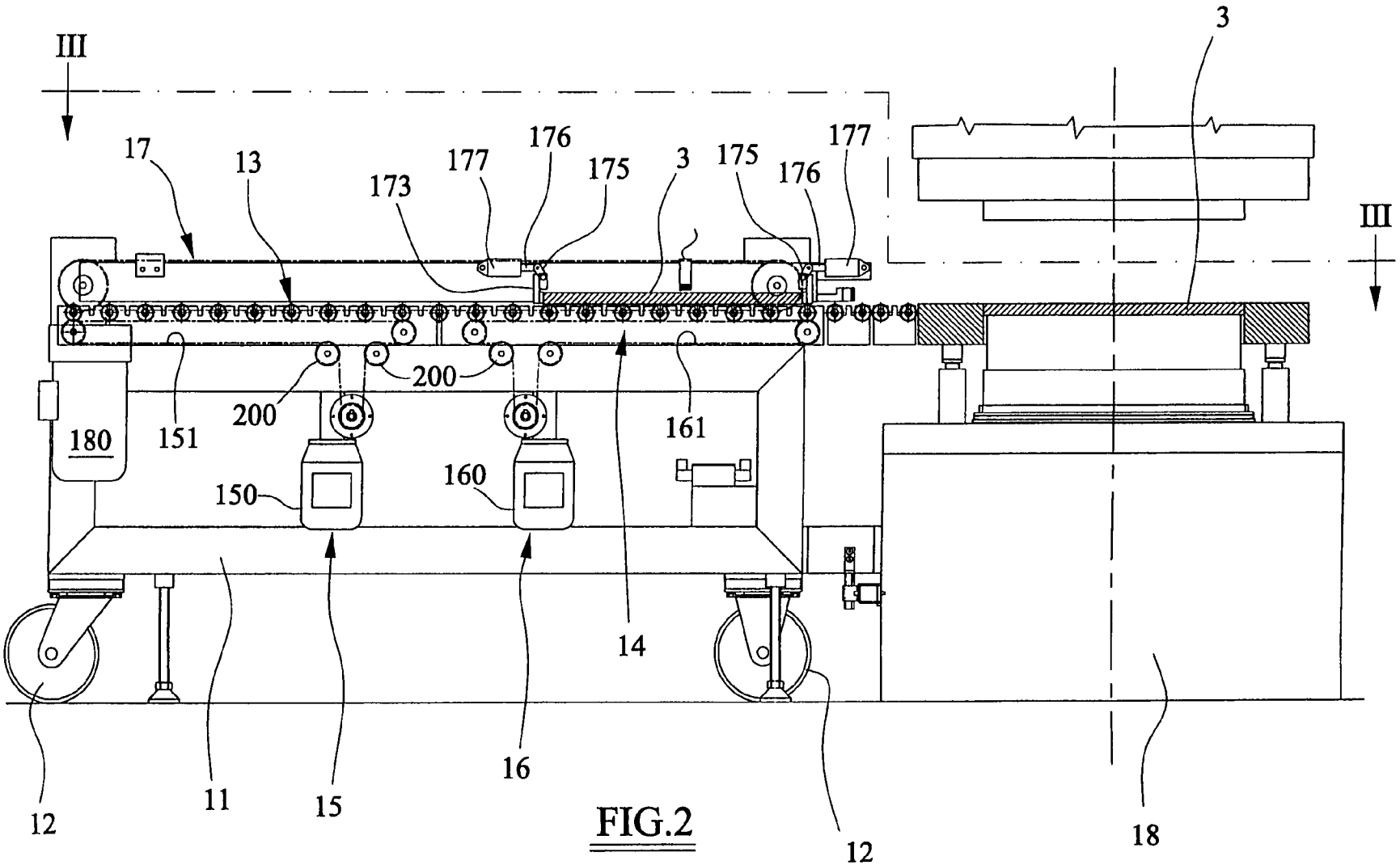
FIG. 2 shows a detail of FIG. 1.

With reference to FIG. 2, each unit comprises a geared motor 150 and 160, to rotate the respective roller table 13 and 14 by means of a toothed belt 151 and 161, which engages a series of pulleys 200.

Above the two roller tables there is positioned a carriage 17 which receives the decorated slab 3, orients it in the correct position, and transports it above the mould cavity of the press.

Figure 3:
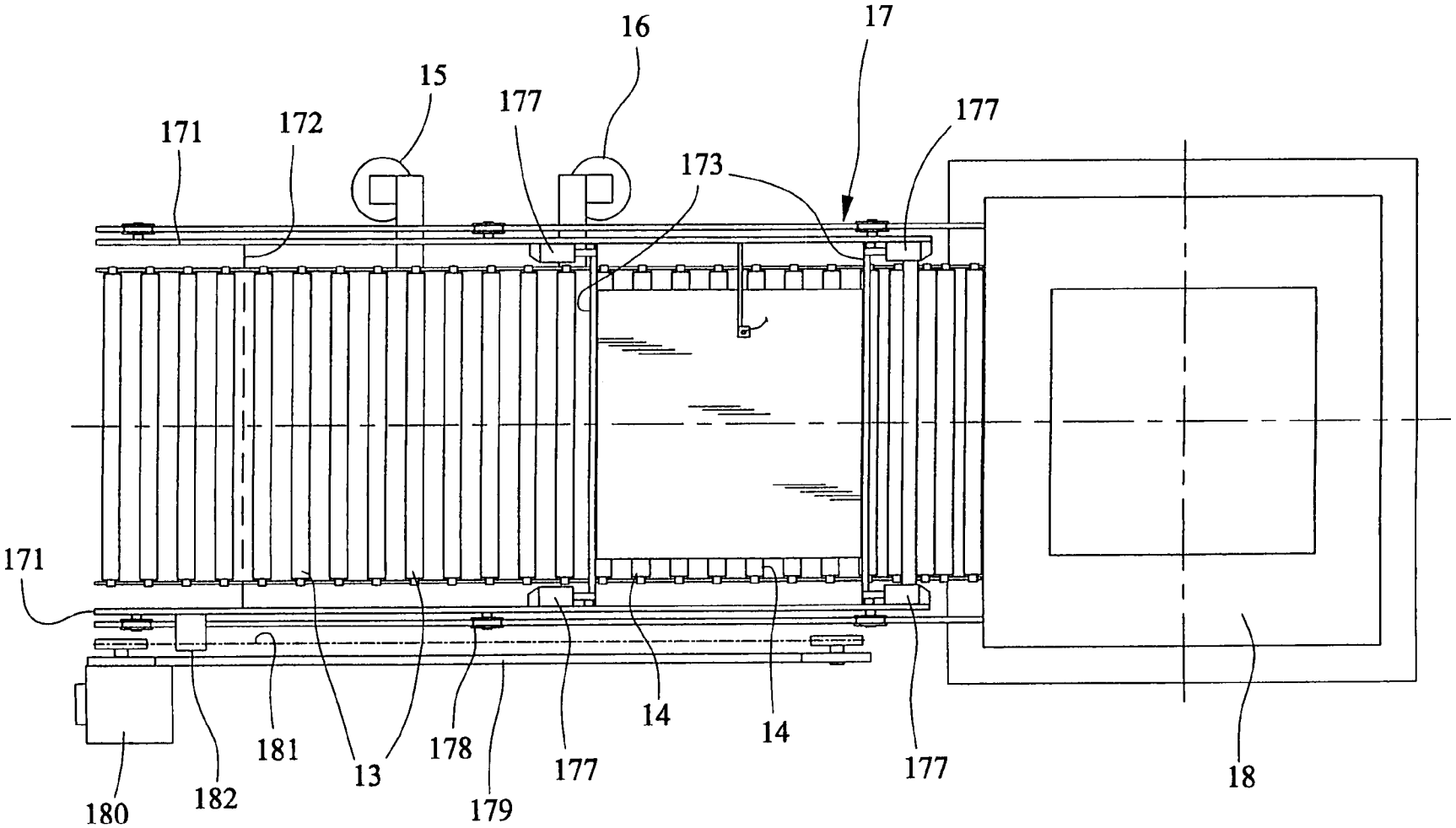
FIG. 3 is a view taken in the direction 111-111 of FIG. 2.

With reference to FIGS. 2 and 3, the carriage 17 comprises two longitudinal members 171 joined together by cross-members 172, one of which is shown in FIG. 3. The carriage 17 is provided with wheels 178 which slide on guides 179 forming part of a structure (FIG. 3) external to the roller tables 3 and 4.

The carriage 17 is driven by a geared motor 180 which rotates a toothed belt 181 to which one end of an element 182 is fixed, the other end of which is rigid with the carriage.

To the front part of the longitudinal members 171 there are also fixed two movable walls 173 arranged to interact respectively with the front edge and rear edge of the slab 3 to both orient it in its correct advancement position and to feed it to the pressing station.

Figure 4:
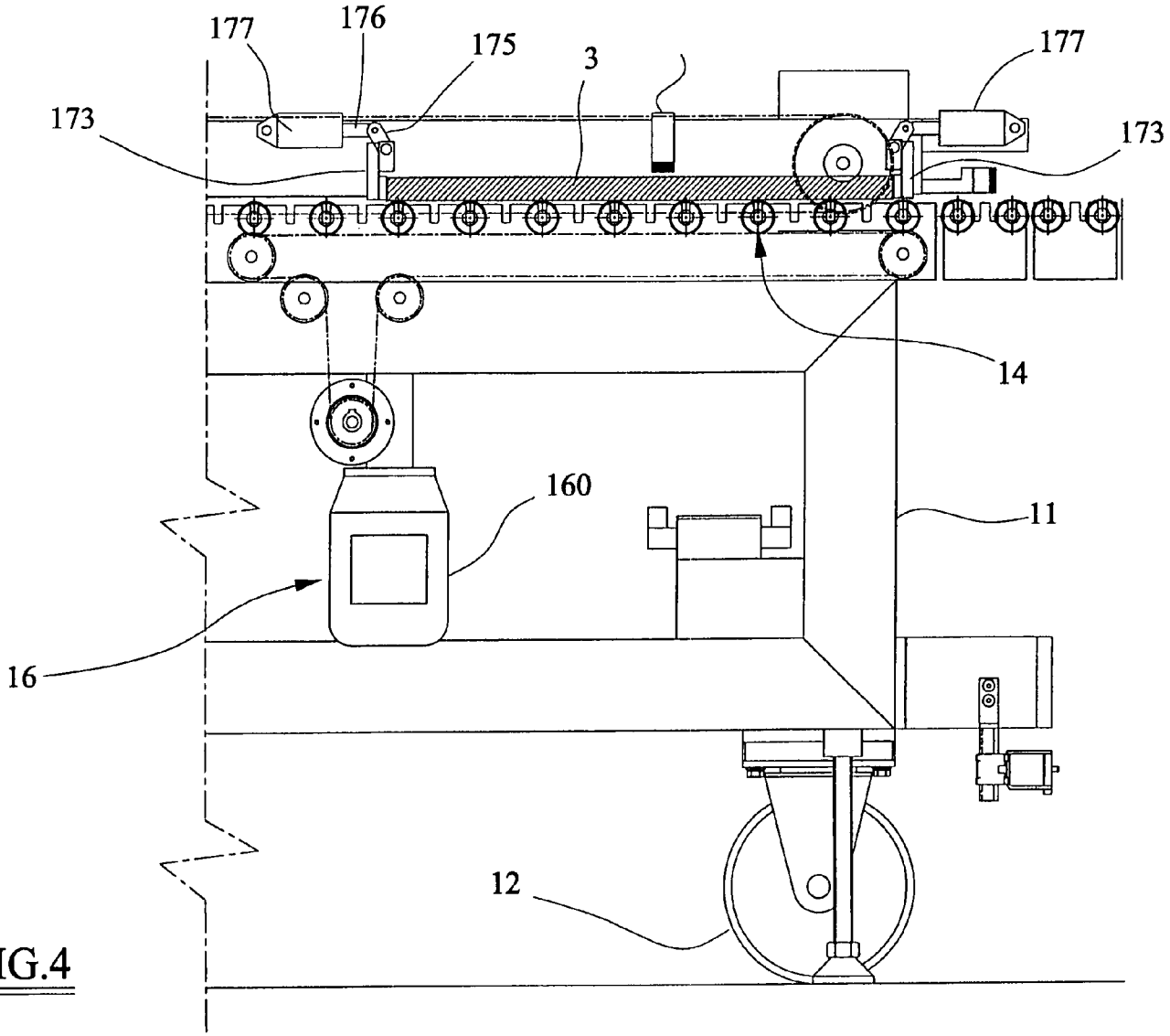
FIG. 4 is an enlarged view of a detail of FIG. 2.

As shown in FIG. 4, the walls 173 are hinged at their upper ends to the longitudinal members 171, and are provided with a lug 175, the free end of which is associated with the rod 176 of a cylinder-piston unit 177.

The cylinder-piston units 177 rotate the walls 173 to move them between a non-operative position, in which the decorated slab 3 is able to pass, driven by the action of the roller table 14, and a lowered operative position, in which they rest against the edges of the decorated slab 3, to lock it and orient it such that the longitudinal axis of the slab coincides perfectly with the longitudinal axis of the carriage.

The operation of the carriage 17 is controlled by a processor, not shown, which also controls the entire forming plant of the invention.

The method, which is apparent from the plant description, results in the creation, by the press 2, of a large-dimension slab to be decorated by at least one decorating station which deposits coloured powders in a predefined pattern on the upper surface of the slab.

For the upper surface of the slab to present good surface stability while enabling the coloured decorating powders to mix intimately with the powders of its upper surface, according to the invention the thickness reduction caused by the first press 2 must be between 20 and 40% of the thickness of the powders fed into the mould cavity. This is achieved by a pressing pressure between 50 and 100 kg/cm$^2$.

Once the slab has been decorated by the decorating stations 8, it is fed to the second press 18, which forms the decorated slab. According to the method of the invention the second pressing takes place at a pressure between 300 and 500 kg/cm$^2$.

The invention claimed is:

1. A plant for forming large-dimension ceramic tiles, comprising:

a first pressing station for precompacting powders to create a consistent slab, means for feeding said slab to at least one decorating station provided with means to deposit a determined quantity of powders onto said slab in a controlled manner, and a second pressing station for said decorated slab, characterized in that between said decorating station and said second pressing station there is provided a feeder device comprising at least two mutually independent motorized conveyor means (13, 14) on which the slab (3) to be pressed advances, said device being operative for making the operating rate of said at least one decorating station independent of the operating rate of the second pressing station.

2. A plant as claimed in claim 1, characterized in that above said two conveyor means (13, 14) there being positioned a carriage (17) arranged to receive said slab (3), lock it in position, and bring it above the mould cavity of said second press (18).

3. A plant as claimed in claim 2, characterized in that the slab is received and locked with the aid of at least one wall (173) movable between a non-operative position in which it is distant from said slab, and an operative position in which it is associated with the rear edge of said slab in its advancement direction.

4. A plant as claimed in claim 3, characterized in that the ends of said movable wall are hinged to the frame of said carriage (17), the wall being associated with at least one cylinder-piston unit (177) which rotates it between said operative positions.

5. A plant as claimed in claim 3, characterized in that said carriage is provided with two identical walls (173), movable between a non-operative position in which they are distant from said slab, and an operative position in which they are associated with the front edge and, respectively, with the rear edge of said slab in its advancement direction.

6. A plant as claimed in claim 2, characterized in that said carriage is operated by a geared motor rotating a toothed belt rigid with said carriage.

* * * * *